US007115019B2

(12) United States Patent
Wakazono

(10) Patent No.: US 7,115,019 B2
(45) Date of Patent: Oct. 3, 2006

(54) GRINDING METHOD AND GRINDING MACHINE

(75) Inventor: Yoshio Wakazono, Nagoya (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 0 days.

(21) Appl. No.: 11/257,150

(22) Filed: Oct. 25, 2005

(65) Prior Publication Data

US 2006/0135043 A1 Jun. 22, 2006

(30) Foreign Application Priority Data

Dec. 16, 2004 (JP) ..... 2004-364546

(51) Int. Cl.
*B24B 49/00* (2006.01)

(52) U.S. Cl. ..... 451/10; 451/11; 451/49; 451/57; 451/249

(58) Field of Classification Search ..... 451/9, 451/10, 11, 242, 246, 249, 49, 51, 57
See application file for complete search history.

(56) References Cited

U.S. PATENT DOCUMENTS 3,797,176 A * 3/1974 Wespi ..... 451/239
3,839,829 A * 10/1974 Price ..... 451/249
3,935,675 A * 2/1976 Price ..... 451/9
4,653,235 A * 3/1987 Farmer ..... 451/5
4,712,332 A * 12/1987 Smith ..... 451/5
6,306,018 B1 * 10/2001 Coverdale et al. ..... 451/49
6,409,573 B1 * 6/2002 Mukai et al. ..... 451/5
6,893,323 B1 * 5/2005 Dougill et al. ..... 451/11

* cited by examiner

*Primary Examiner*—Eileen P. Morgan
(74) *Attorney, Agent, or Firm*—Oblon, Spivak, McClelland, Maier & Neustadt, P.C.

(57) ABSTRACT

In a grinding machine, a generally cylindrical workpiece having at least first and second grinding areas is ground by use of a grinding wheel supported by a wheel head. The first grinding area is first ground such that power consumed by the grinding machine is maintained at a first level. After completion of grinding for the first grinding area, the grinding wheel is indexed to the second grinding area by moving the wheel head such that the power consumed by the grinding machine is maintained at a second level higher than the first level. After completion of the indexing operation, the second grinding area is ground in the same manner as the first grinding area.

8 Claims, 8 Drawing Sheets

| | GRINDING MCHINE OF THE INVENTION | CONVENTIONAL GRINDING MACHINE |
|---|---|---|
| WHEEL OUTER DIAMETER mm | Ø150 | Ø350 |
| WHELL MASS kg | 1.2 | 15 |
| WHEEL SHAFT DIAMETER mm | Ø40 | Ø75 |
| WHEEL HEAD MASS kg | 150 | 800 |
| GRINDING SPEED mm/s | 120 | |
| POWER CONSUMTION WITH WHEEL IDLING kW | 1 | 4 |
| MAXIMUM ACCELARATION | 1G | 0.08G |
| MAXIMUM SPEED m/min | 80 | 10 |

GRINDING METHOD AND GRINDING MACHINE

INCORPORATION BY REFERENCE

The present application claims priority under 35 U.S.C. §119 to Japanese Patent Application No. 2004-364546, filed on Dec. 16, 2004. The contents of that application are incorporated herein by reference in their entirety.

BACKGROUND OF THE INVENTION

1. Field of the Invention

The present invention relates to a grinding method and a grinding machine for grinding a workpiece with a rotating grinding wheel, and more particularly to an environmentally-friendly grinding method and machine which can reduce the consumption of energy from start to end of workpiece grinding operation.

2. Description of the Related Art

Conventionally, there has been known a grinding machine in which a wheel head that rotatably supports a grinding wheel in a cantilever fashion by means of static bearings is mounted on a bed via a slide mechanism such that the wheel head can be advanced toward and retreated from a workpiece rotatably supported between a spindle head and a tailstook (see, for example, Japanese Patent Application Laid-Open (kokai) Nos. H10-118922 and 2001-82473. In such a grinding machine, the workpiece is ground with the grinding wheel, while coolant is fed from a coolant nozzle toward a grinding zone between the grinding wheel and the workpiece.

Specifically, Japanese Patent Application Laid-Open No. H10-118922 discloses a grinding machine in which a wheel head is slidably guided along a pair of guides provided on a bed, and which includes a feed mechanism which transmits rotational torque of a servomotor fixed to the bed to the wheel head via a ball-screw mechanism so as to advance and retreat the wheel head. A grinding wheel is rotatably supported on the wheel head in a cantilever fashion via static bearings.

Japanese Patent Application Laid-Open No. 2001-82473 discloses a grinding machine in which lubrication oil supplied to bearing portions is caused to flow from oil discharge grooves to an oil reservoir portion for temporary accumulation and then flow out toward a lubrication oil supply apparatus via a drain port.

In conventional grinding machines, since a grinding wheel is rotatably supported on a wheel head in a cantilever fashion via static bearings, the shaft of the grinding wheel and bearing portions thereof are designed to have large diameters in order to increase rigidity during grinding operation, to thereby secure machining accuracy.

Further, the bearing portions are supported by means of static bearings, and lubrication oil supplied to the bearing portions is caused to flow from oil discharge grooves to an oil reservoir portion for temporary accumulation and then flow out toward a lubrication oil supply apparatus via a drain port. Therefore, the above-mentioned oil reservoir portion is provided on the wheel head, which is a movable section.

However, in the conventional grinding machines, since the shaft of the grinding wheel and the bearing portions thereof have large diameters and the oil reservoir portion is provided on the wheel head, the weight of the movable section is large, which makes it difficult to move the movable section at high speed or to move the movable section at large acceleration.

In other words, since the movable section is moved at low speed and low acceleration in order to render the consumed power at the time of indexing the grinding wheel smaller than that at the time of grinding a workpiece, the time required to index the grinding wheel, and thus, the time required to machine the workpiece cannot be shortened, so that the quantity of consumed energy cannot be reduced.

SUMMARY OF THE INVENTION

In view of the foregoing, an object of the present invention is to provide a grinding method and a grinding machine which can shorten the time required to machine a workpiece by shortening the time required to index the grinding wheel, to thereby reduce energy consumption.

In order to achieve the above and other objects, the present invention provides a grinding method and a grinding machine for grinding at least first and second axially separated grinding areas of a generally cylindrical, elongated workpiece, wherein the workpiece is rotatably supported by a main spindle disposed on a bed of the grinding machine, and the grinding areas of the workpiece are ground by a grinding wheel supported on a movable body movably disposed on the bed. Each of the first and second grinding areas of the workpiece is ground by the grinding wheel for a first period of time such that power consumed by the grinding machine is maintained at a first level. After completion of grinding for the first grinding area, the grinding wheel is indexed to the second grinding area by moving the movable body for a second period of time such that the power consumed by the grinding machine is maintained at a second level higher than the first level, the second period of time being determined in accordance with the second level. Preferably, at the time of indexing the grinding wheel, the movable body is moved in a direction perpendicular to an axis of the workpiece and in a direction parallel to the axis of the workpiece.

The present invention also provides a grinding machine which comprises a spindle head disposed on a bed of the grinding machine and adapted to support and rotate a generally cylindrical, elongated workpiece having at least first and second axially separated grinding areas to be ground; a grinding wheel rotatably supported on a wheel head movably disposed on the bed; a feed mechanism including motors for moving the grinding wheel in a direction parallel to an axis of the workpiece and in a direction perpendicular to the axis of the workpiece; drive circuits connected to the motors and driving the motors; and a control apparatus connected to the drive circuits. The control apparatus controls movement of the grinding wheel relative to the workpiece so as to grind each of the first and second grinding areas of the workpiece by the grinding wheel for a first period of time such that power consumed by the grinding machine is maintained at a first level, and to move, after completion of grinding for the first grinding area, the grinding wheel to the second grinding area by moving the wheel head for a second period of time such that the power consumed by the grinding machine is maintained at a second level higher than the first level, the second period of time being determined in accordance with the second level. The motors are may be linear motors.

Preferably, after completion of grinding for the first grinding area, the control apparatus moves the grinding wheel to the second grinding area by moving the wheel head at an acceleration corresponding to a mass of the wheel head for a period of time corresponding to the acceleration.

Preferably, the control apparatus moves the grinding wheel to the second grinding area by accelerating the wheel head at an acceleration corresponding to the mass of the wheel head and then decelerating the wheel head at a deceleration having an absolute value approximately equal to that of the acceleration.

According to the present invention, the grinding wheel can be indexed at a higher speed as compared with conventional grinding machines, whereby the total time from start of grinding of a workpiece to end of grinding can be shortened, and the quantity of consumed energy can be reduced.

BRIEF DESCRIPTION OF THE DRAWINGS

Various other objects, features, and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

Structure of Grinding Machine:

A grinding machine according to an embodiment of the present invention will be described with reference to the drawings. Notably, in order to facilitate description, the positional relations among constituent members of the grinding machine will be described, while the position of a user or operator standing in front of the grinding machine (on the left side in FIG. 1) is used as a reference point. Specifically, a direction toward the operator will be referred to as "front," a direction away from the operator will be referred to as "rear." a rightward direction with respect to the operator will be referred to as "right," and a leftward direction with respect to the operator will be referred to as "left." Further, a front-rear direction will be referred as the "X-axis direction," and a left-right direction will be referred as the "Z-axis direction."

Figure 1:
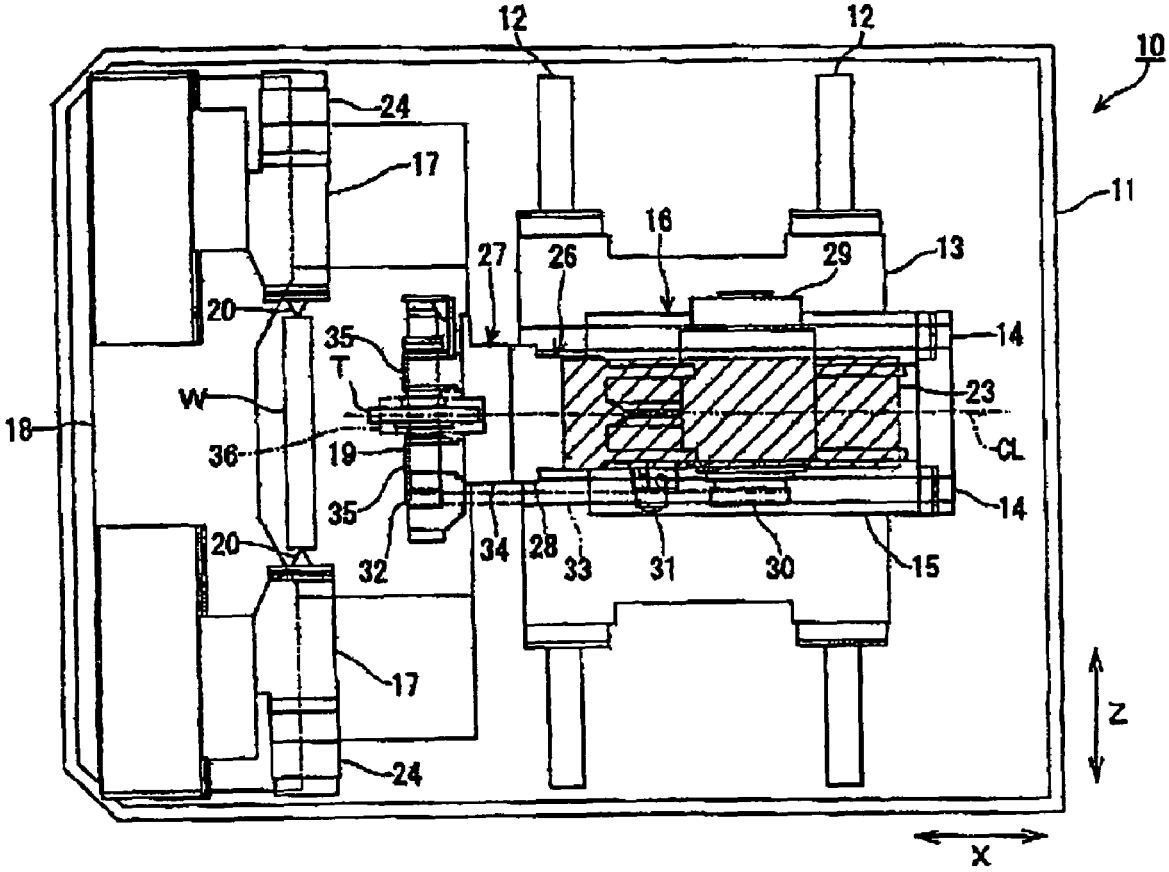
FIG. 1 is a plan view of a cylindrical grinding machine according to an embodiment of the present invention.
Figure 2:
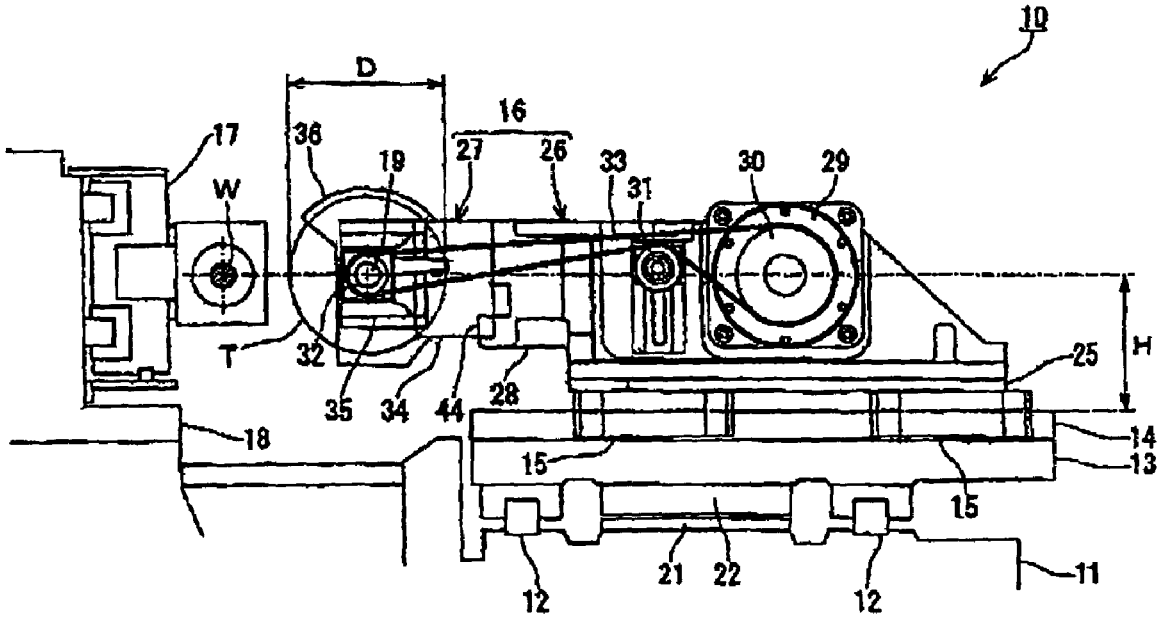
FIG. 2 is a side view of the cylindrical grinding machine shown in FIG. 1.

FIG. 1 is a plan view of a cylindrical grinding machine 10 according to the embodiment of the present invention, and FIG. 2 is a side view of the cylindrical grinding machine 10.

Figure 5:
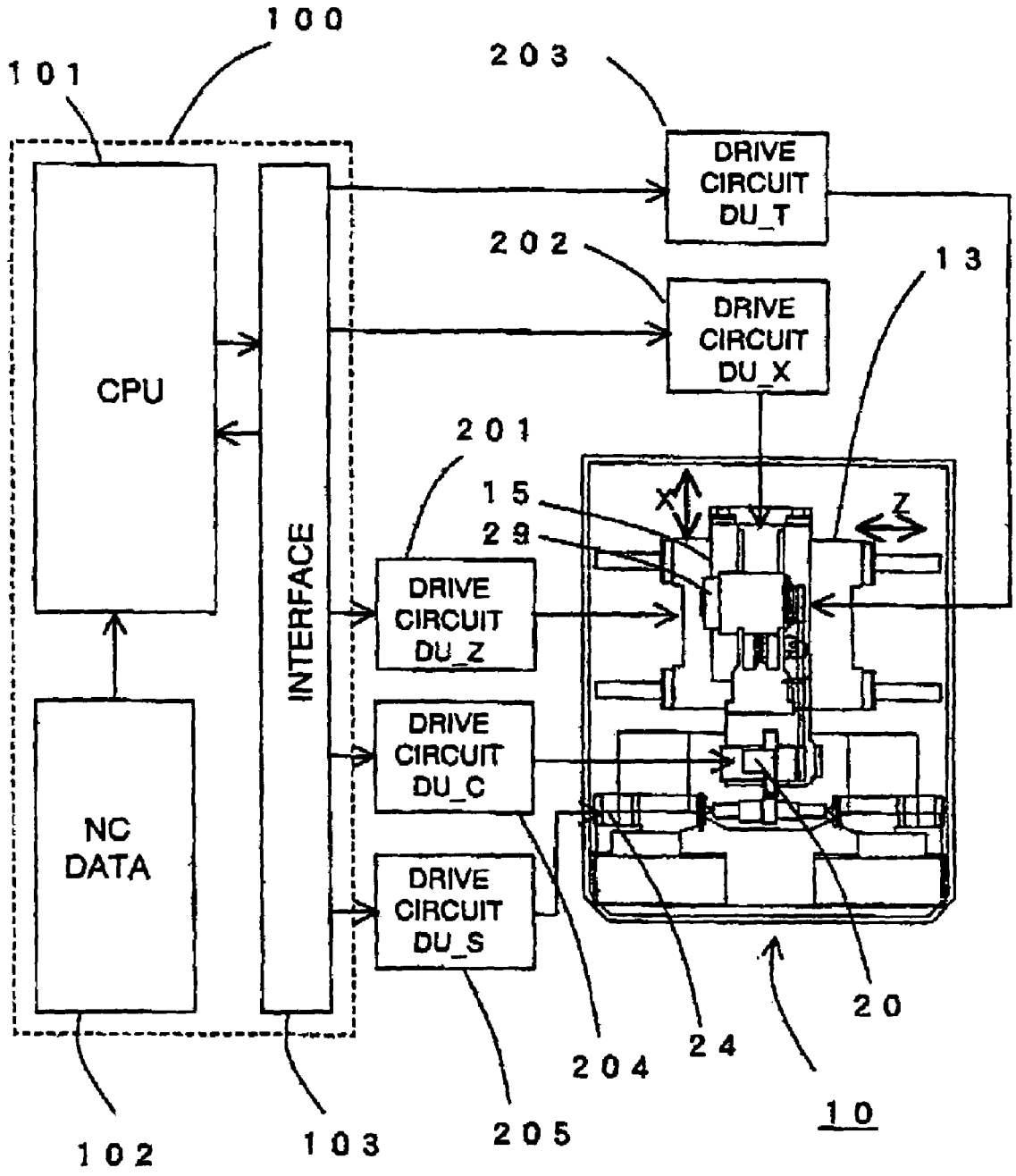
FIG. 5 is a diagram showing a system including a computerized numerical controller according to the present invention.

The cylindrical grinding machine 10 is controlled by means of a computerized numerical control (CNC) apparatus 100 (shown in FIG. 5). The cylindrical grinding machine 10 is composed of a grinding machine main body, and unillustrated auxiliary apparatuses. Main auxiliary apparatuses are a coolant supply apparatus, a mist collection apparatus, and a duct apparatus for connecting these apparatus to the grinding machine main body.

The cylindrical grinding machine 10 includes a bed 11, which constitutes a base portion of the grinding machine 10; a pair of Z-axis rails 12 disposed on the top surface of the bed 11 and extending in the Z-axis direction; a Z-axis movable unit (movable body) 13 that is moved along the Z-axis rails 12 in the Z-axis direction; a pair of X-axis rails 14 disposed on the top surface of the Z-axis movable unit 13 and extending in the X-axis direction; an X-axis movable unit (movable body) 15 that is moved along the X-axis rails 14 in the X-axis direction; a wheel head 16 disposed on the top surface of the X-axis movable unit 15 and rotatably supporting a grinding wheel T; and right-hand and left-hand spindle heads 17 disposed on the top surface of the bed 11 and supporting a workpiece W, which is rotated by means of spindle motors 24.

The Z-axis movable unit 13 is driven by means of a linear motor. The linear motor includes a magnet 21 disposed on the top surface of the bed 11 to be located between the pair of Z-axis rails 12 and a coil 22 disposed on the bottom surface of the Z-axis movable unit 13. The coil 22 generates an electric field upon supply of electricity thereto, and the magnet 21 produces power or propelling force as a result of interaction between the electric field and a magnetic field generated by the magnet 21. Thus, the Z-axis movable unit 13 is moved by this linear motor in the Z-axis direction.

Similarly, the X-axis movable unit 15 is also driven by means of a linear motor. The linear motor includes an unillustrated magnet disposed on the top surface of the Z-axis movable unit 13 to be located between the pair of X-axis rails 14 and a coil 23 (a hatched portion in FIG. 1) disposed on the bottom surface of the X-axis movable unit 15. The X-axis movable unit 15 is moved by this linear motor in the X-axis direction.

The X-axis movable unit 15 includes a base 25 disposed on the Z-axis movable unit 13; a wheel-head main body 26, which constitutes a main portion of the wheel head 16; and a wheel shaft unit 27 removably attached to the wheel-head main body 26 and carrying a wheel shaft 19. The wheel-head main body 26 has a projecting portion 28 projecting forward from the base 25. The wheel shaft unit 27 is attached to the front face of the projecting portion 28. Therefore, the wheel head T is greatly shifted forward from the wheel head 16; i.e., is in a so-called "overhung state." Notably, the wheel-head main body 26 may be disposed directly on the Z-axis movable unit 13 without interposition of the base 25 therebetween. Further, the wheel shaft 19 may be provided on the wheel-head main body 26 itself, rather than being providing on the wheel shaft unit 27, which is a unit removably attached to the wheel-head main body 26.

The grinding wheel T is detachably attached to the wheel shaft 19, and rotates when the wheel shaft 19 is rotated.

The wheel-head main body 26 includes rotation-drive means 29 for rotating the wheel shaft 19. The rotation-drive means 29 is a so-called "built-in motor" whose outer housing is formed integrally with the wheel-head main body 26. A drive pulley 30 is fixed to a tip end of the rotary shaft of the rotation-drive means 29, and rotates together with the rotary shaft.

A tension pulley 31 is provided on the wheel-head main body 26 to be located forward (on the left side in FIG. 2) of the drive pulley 30 and to be movable in the vertical direction. Through adjustment of the vertical position of the tension pulley 31, the tension of a belt 33, which is wound around the drive pulley 30 and a wheel-shaft pulley 32 to be described later, can be adjusted.

The wheel shaft unit 27 includes a unit base 34 detachably attached to the front face of the projecting portion 28 of the wheel-head main body 26; left-hand and right-hand hydraulic bearings 35 attached to the front face of the unit base 34; the wheel shaft 19, opposite ends of which are supported by the corresponding hydraulic bearings 35 and to which the grinding wheel T is fixed; and a wheel cover 36 for covering the grinding wheel T.

Figure 3:
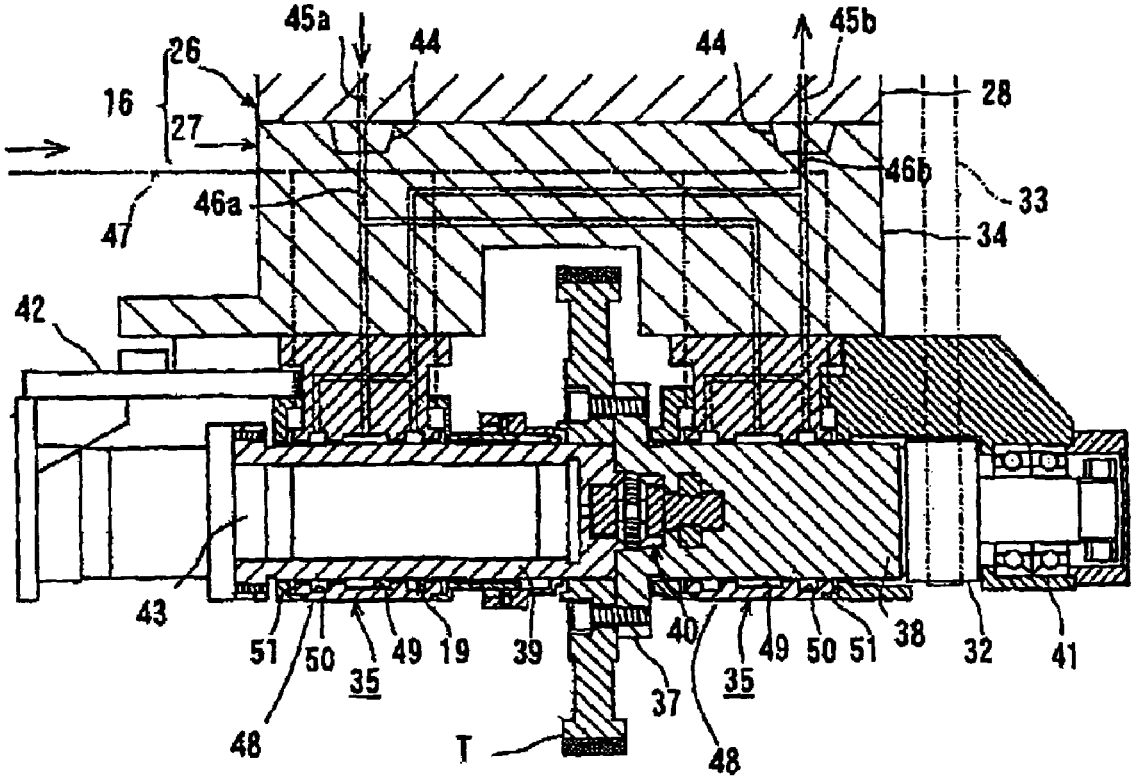
FIG. 3 is a partially sectioned plan view of the wheel head of the cylindrical grinding machine shown in FIG. 1.

As shown in FIG. 3, the wheel shaft 19, which is parallel to the Z-axis direction, is composed of a first shaft portion 38 having a flange portion 37 at its one end for attachment of the grinding wheel T; a second shaft portion 39 connectable to the end of the first shaft portion 38; and connection means 40 for connecting the first shaft portion 38 and the second shaft portion 39 together and separating them from each other.

The first shaft portion 38 is rotatably supported by means of one of the hydraulic bearings 35 in the vicinity of the flange portion 37, and the opposite end of the first shaft portion 38 is supported by means of a thrust bearing 41. The wheel-shaft pulley 32 is fixed to the first shaft portion 38 at a location between the hydraulic bearing 35 and the thrust bearing 41. As described above, the belt 33 is wound around the wheel-shaft pulley 32 and the drive pulley 30 of the wheel-head main body 26, whereby rotational force is transmitted from the rotation-drive means 29 to the wheel shaft 19, and thus the wheel shaft 19 rotates.

Moving means 42 for axially moving the second shaft portion 39 is provided at one end of the second shaft portion 39 opposite the end which is connected to the first shaft portion 38. The second shaft portion 39 is rotatably supported by the other hydraulic bearing 35 at a location between the moving means 42 and the end connected to the first shaft portion 38. Notably, in FIG. 3, reference numeral 43 denotes an auto-balancer for automatically correcting deflection of the grinding wheel T.

In an ordinary state, the first shaft portion 38 and the second shaft portion 39 are connected to each other by means of the connection means 40. When the grinding wheel T is replaced with another grinding wheel, the connection between the first shaft portion 38 and the second shaft portion 39 by means of the connection means 40 is released, and the second shaft portion 39 is moved away from the first shaft portion 38, whereby a predetermined clearance is formed between the first shaft portion 38 and the second shaft portion 39. In this state, through the clearance, the grinding wheel T is detached from and attached to the flange portion 37 of the first shaft portion 38 by use of bolts.

The hydraulic bearings 35 of the wheel shaft unit 27 are operated by a fluid supplied via supply passages formed in the wheel shaft unit 27 and the wheel-head main body 26. Notably, connection means 44 is provided between the wheel shaft unit 27 and the wheel-head main body 26 so as to connect or disconnect the supply passages provided in the wheel shaft unit 27 and those provided in the wheel-head main body 26.

Figure 4A:
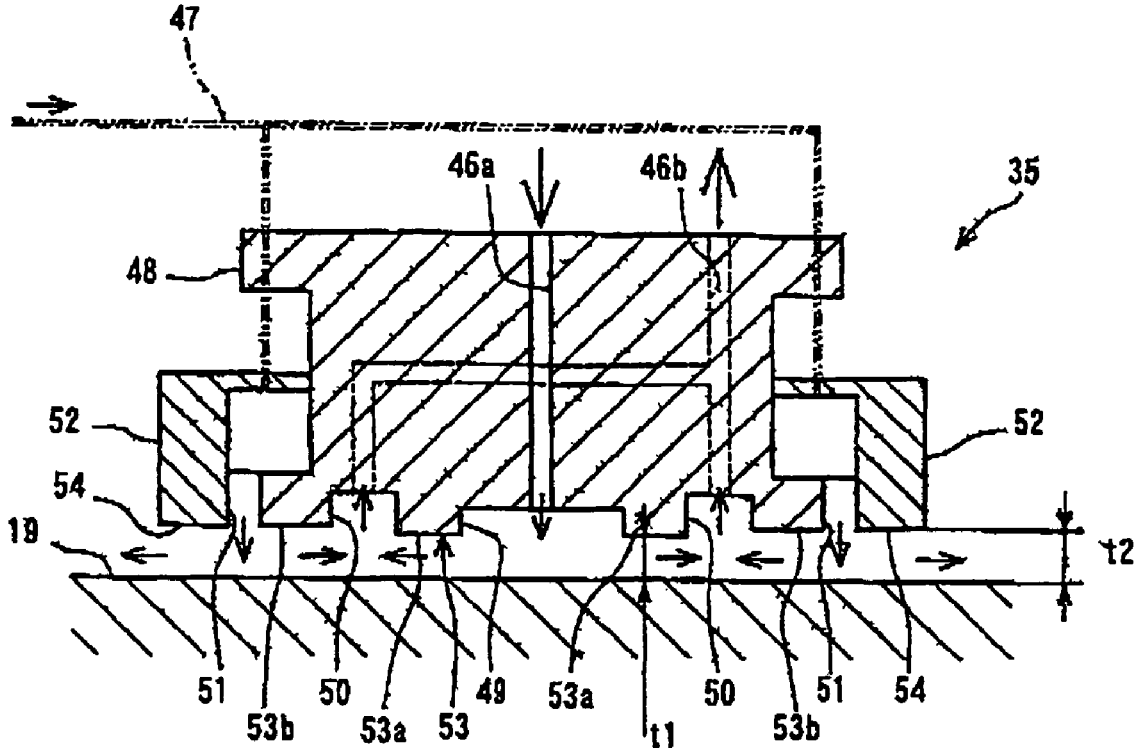
FIG. 4A is an enlarged sectional view of a hydraulic bearing shown in FIG. 3.

As shown in FIG. 4A, each of the hydraulic bearings 35 includes a bearing member 48, which rotatably supports the wheel shaft 19 and which has a first supply portion 49 for supplying lubrication oil between the bearing member 48 and the wheel shaft 19, and collecting portions 50 disposed axially outward of the first supply portion 49 and adapted to collect the lubrication oil. Further, second supply portions 51 are provided axially outward of the collecting portions 50 so as to supply air pressurized to a predetermined pressure. End members 52 are provided on the opposite sides of the bearing member 48 of the hydraulic bearing 35 with respect to the axial direction such that clearances of a predetermined size are formed between the end members 52 and the corresponding axial ends of the bearing member 48. The clearances serve as the second supply portions 51.

The bearing member 48 has an inner diameter slightly greater than the outer diameter of the wheel shaft 19, and the first supply portion 49 and the collection portions 50 are formed on the inner circumference surface 53 of the bearing member 48. The bearing member 48 is formed such that the clearance t1 between the wheel shaft 19 and each of inner circumferential surfaces 53*a* between the first supply portion 49 and the collection portions 50 is slightly smaller than the clearance t2 between the wheel shaft 19 and each of inner circumferential surfaces 53*b* between the collection portions 50 and the corresponding second supply portion 51.

Further, the end members 52 are formed such that their inner circumferential surfaces 54 become substantially flush with the inner circumferential surfaces 53*b* of the bearing member 48 located between the collection portions 50 and the corresponding second supply portions 51. The support accuracy, etc. of the hydraulic bearing 35 can be adjusted through appropriate setting of clearances between these inner circumferential surfaces and the wheel shaft 19.

Figure 4B:
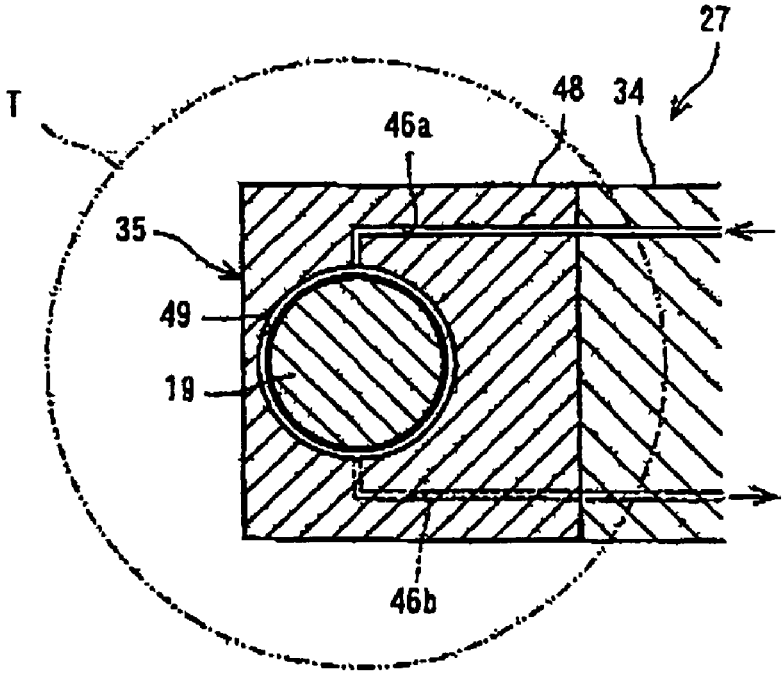
FIG. 4B is a transverse sectional view of the hydraulic bearing shown in FIG. 4A.

As shown in FIG. 4B, a through hole, which partially constitutes a unit-side supply passage 46*a*, is formed in the hydraulic bearing 35 (i.e., the bearing member 48) so as to communicate with the first support portion 49 at locations above the wheel shaft 19. Similarly, through holes, which partially constitute a unit-side collection passage 46*b*, are formed in the hydraulic bearing 35 (i.e., the bearing member 48) so as to communicate with the collection portions 50 at locations under the wheel shaft 19. The unit-side supply passage 46*a* and the unit-side collection passage 46*b* are connected to a body-side supply passage 45*a* and a body-side collection passage 45*b* of the wheel-head main body 26 by means of the connection means 44. Further, the body-side supply passage 45*a* and the body-side collection passage 45*b* are connected to a pump and a tank, respectively, of an unillustrated lubrication oil supply apparatus.

Lubrication oil stored in the tank of the lubrication oil supply apparatus is pressurized to a predetermined pressure by the pump and is supplied to the first supply portion 49 via the body-side supply passage 45*a* and the unit-side supply passage 46*a*. Lubrication oil collected from the collection portions 50 is collected to the tank via the unit-side collection passage 46*b* and the body-side collection passage 45*b*.

An air supply passage 47 is connected to the second supply portions 51, and air of a predetermined pressure from an unillustrated air supply apparatus is supplied to the second supply portions 51 via the air supply passage 47. Notably, the grinding wheel T is a CBN (cubic boron nitride) grinding wheel having a diameter of 100 to 200 mm, which is smaller than that of ordinary grinding wheels. Although not illustrated, the wheel shaft unit 27 and the wheel-head main body 26 are fixed together by use of bolts or a lock mechanism.

Action of Hydraulic Bearing:

Next, action of the hydraulic bearing 35 used in the cylindrical grinding machine 10 of the present embodiment will be described. When the lubrication oil stored in the tank of the unillustrated lubrication oil supply apparatus is pumped by the pump and is supplied under a predetermined pressure to the first supply portion 49 via the body-side supply passage 45*a* and the unit-side supply passage 46*a*, the wheel shaft 19 is supported by means of the pressurized lubrication oil without contact with the inner circumferential surface 53 of the bearing member 48.

In this state, rotational force from the rotation-drive mans 29 is transmitted to the wheel shaft 19 via the drive pulley 30, the belt 33, and the wheel-shaft pulley 32. Thus, the wheel shaft 19 rotates smoothly. The lubrication oil supplied to the first supply portion 49 flows to the collection portions 50 while passing through the clearance t1 between the wheel shaft 19 and each of the inner circumferential surfaces 53*a* between the first supply portion 49 and the collection portions 50.

Meanwhile, pressurized air is supplied from the air supply apparatus to the second supply portions 51 via the air supply passage 47. The air supplied to each second supply portion 51 diverges and flows toward the corresponding collection portion 50 and toward the axial end side opposite the collection portion 50.

The air having flowed from the second supply portion 51 toward the collection portion 50 flows into the unit-side collection passage 46*b* connected to the collection portion 50. By virtue of this air flow, the lubrication oil having flowed from the first supply portion 49 to the collection portions 50 is caused to flow toward the unit-side collection passage 46*b*, whereby lubrication oil is collected together with air and fed to the tank via the unit-side collection passage 46*b* and the body-side collection passage 45*b*.

Meanwhile, the air having flowed from the second supply portion 51 toward the axial end side opposite the collection portion 50 flows to the outside of the hydraulic bearing 35 from the outer end of the end member 52. That is, air purging is performed.

As described, collection of the lubrication oil supplied to the first supply portion 49 is promoted by air supplied to the second supply portions 51. Therefore, the time required to collect the lubrication oil can be shortened. In addition, since the air supplied to the second supply portions 51 prevents the lubrication oil supplied to the first supply portion 49 from flowing out from the opposite axial ends of the bearing member 48, consumption of lubrication oil can be reduced. Further, since collection of the lubrication oil supplied to the first supply portion 49 is promoted, an oil reservoir portion, which has been conventionally provided under the hydraulic bearing 35, becomes unnecessary. Accordingly, the wheel head 16 can be greatly reduced in size and weight.

Moreover, since the grinding wheel T is supported on opposite sides by means of the hydraulic bearings 35, grinding load (grinding reaction) acting on the grinding wheel T during grinding operation can be received by the hydraulic bearings 35. Therefore, even when the diameter of the wheel shaft 19 is made smaller than that in the case of a cantilever structure employed in conventional grinding machines, rigidity comparable to that attained by the cantilever structure can be obtained. Therefore, the size and weight of the wheel head 16 can be reduced, while high machining accuracy is maintained.

Since the weight of the wheel head 16 can be greatly reduced through reduction of consumption of lubrication oil and reduction of shaft diameter, which is realized through employment of a double-side support structure, the masses of the Z-axis movable unit 13 and that of the X-axis movable unit 15 can be greatly reduced, and thus, they can be moved in the Z-axis and X-axis directions, respectively, at high speed, through drive by means of the linear motors.

System of the Present Invention:

FIG. 5 shows a system including a computerized numerical control (CNC) apparatus according to the present invention. This system includes the cylindrical grinding machine 10; the CNC apparatus 100; a drive circuit (DU_Z) 201 for driving the Z-axis movable unit 13, a drive circuit (DU_X) 202 for driving the X-axis movable unit 15; a drive circuit (DU_T) 203 for driving the rotation-drive means 29; a drive circuit (DU_C) 204 for driving the coolant supply apparatus 20; and a drive circuit (DU_S) 205 for driving the spindle motors 24.

The CNC apparatus 100 program-controls the drive circuits 201 to 205 via an interface 103 with reference to NC data 102 based on machining data.

The drive circuit (DU_Z) 201 supplies electricity to the coil 22 to thereby generate an electric field which interacts with a magnetic field of the magnet 21, whereby mechanical power is generated, and the Z-axis movable unit 13 is moved in the Z-axis direction.

Similarly, the drive circuit (DU_X) 202 supplies electricity to the coil 23 to thereby generate an electric field which interacts with a magnetic field of the unillustrated magnet, whereby mechanical power is generated, and the X-axis movable unit 15 is moved in the X-axis direction.

The drive circuit (DU_T) 203 drives the rotation-drive means 29, which is a built-in motor, to thereby rotate the wheel shaft 19 and the grinding wheel T via the drive pulley 30, the belt 33, and the wheel-shaft pulley 32.

The drive circuit (DU_C) 204 drives the coolant supply apparatus 20 so as to supply coolant to a grinding point.

The drive circuit (DU_S) 205 drives the spindle motors 24 so as to rotate the workpiece W, attached to the spindle heads 17, at a predetermined rotational speed.

Figure 6A:
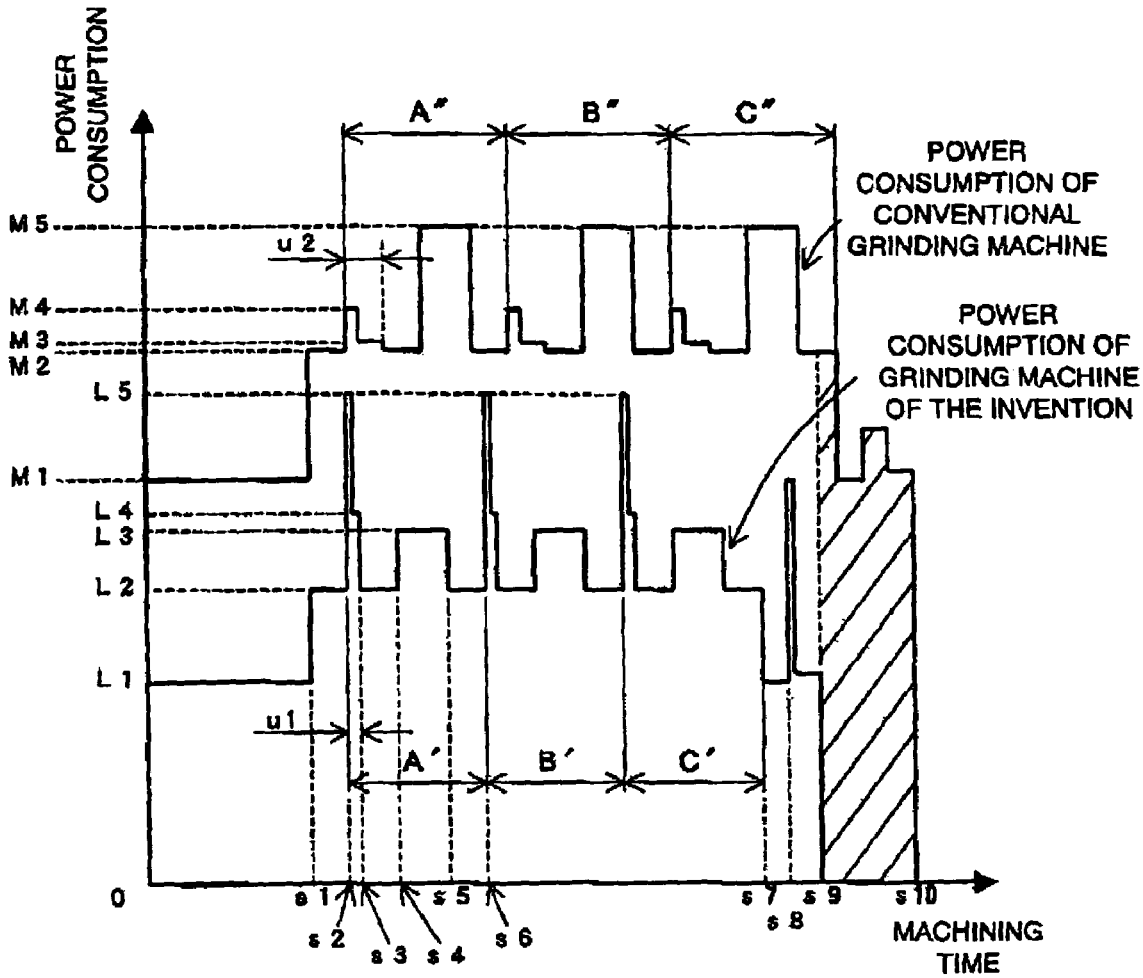
FIG. 6A is a time chart showing changes in consumed power with time in a conventional grinding machine and changes in consumed power with time in the grinding machine according to the embodiment.
Figure 6B:
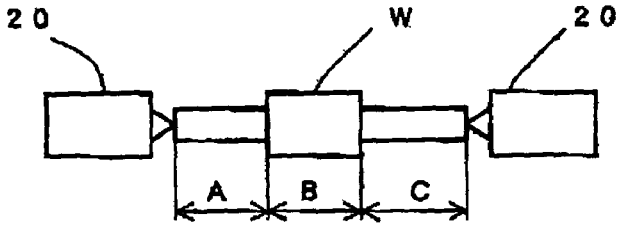
FIG. 6B is a schematic view showing the shape of a workpiece to be ground and grinding areas, which are portions to be ground.

FIG. 6A is a time chart showing changes in power consumption with time in a conventional cylindrical grinding machine and the cylindrical grinding machine according to the present embodiment, in which a lower curve shows power consumption of the cylindrical grinding machine according to the present embodiment, and an upper curve shows power consumption of the conventional cylindrical grinding machine. FIG. 6B is a schematic view showing the shape of a workpiece W to be ground and portions to be machined (grinding areas) thereof. In the present embodiment, the workpiece W has three grinding areas A, B, and C. In the power consumption curve for the cylindrical grinding machine according to the present embodiment, sections A', B', and C' correspond to the grinding areas A, B, and C. In the power consumption curve for the conventional cylindrical grinding machine, sections A", B", and C" correspond to the grinding areas A, B, and C.

First, with reference to FIG. 6A, there will be described the power consumption of the cylindrical grinding machine according to the present embodiment when it grinds the workpiece W shown in FIG. 6B.

The time after completion of attachment of the workpiece W to the spindle heads 17 and other preparatory operations necessary for machining is regarded as a machining time of 0 (i.e., zero point in the horizontal axis), and power consumption at that time is regarded as a power consumption of 0 (i.e., zero point in the vertical axis). When operation of the cylindrical grinding machine is started, drive of the spindle motors 24 by means of the drive circuit (DU_S) 205 is started, so that the workpiece W rotates at a predetermined speed, and rotation of the grinding wheel T by means of the drive circuit (DU_T) 203 is started. The power consumption at this time is L1. Next, at time s1, drive of the coolant supply apparatus 20 by means of the drive circuit (DU_C) 204 is started so as to supply coolant to a grinding point. The power consumption at this time is L2.

Next, during a period between times s2 and s3, electricity is supplied to the coil 22 by mean of the drive circuit (DU_Z) 201 so that the Z-axis movable unit 13 is moved in the Z-axis direction by means of the corresponding linear motor. Further, electricity is supplied to the coil 23 by mean of the drive circuit (DU_X) 202 so that the X-axis movable unit 15 is moved in the X-axis direction by means of the corresponding linear motor. The period between times s2 and s3 is a positioning period in which the grinding wheel T is positioned to a predetermined index position through movements in the Z-axis and X-axis directions. This positioning operation is performed to move the grinding wheel T among the grinding areas A, B, and C, and is also called "indexing" or "indexing operation." The power consumption at this time is L5. In the power consumption curve shown in FIG. 6A, the power consumption L5 at the time of indexing in the Z-axis direction is greater than power consumption L4 at the time of indexing in the X-axis direction. However, the cylindrical grinding machine may be controlled in such a manner that the power consumption L5 at the time of indexing in the Z-axis direction becomes smaller than the power consumption L4 at the time of indexing in the X-axis direction. Further, the indexing in the Z-axis direction and the indexing in the X-axis direction may be performed concurrently at least in a portion of the entire indexing operation. The cylindrical grinding machine is characterized in that the power consumption at the time of indexing operation is greater than power consumption L3 at the time of grinding, which will be described later. The effect of the present invention can be attained insofar as at least one of power consumption at the time of indexing in the Z-axis direction and power consumption at the time of indexing in the X-axis direction is greater than the power consumption L3 at the time of grinding operation.

During a period up to s4, the grinding wheel T, which is supported on the X-axis and Z-axis movable units 15 and 13 having been positioned through the above-described indexing operation, is fed from the predetermined index position toward the workpiece W so as to start grinding. This feed operation is also called "approaching," and the power consumption in this period is L2, which is substantially the same as in the period between s1 and s2.

After completion of the approaching, grinding operation is performed up to s5. Because of an increase in machining load, the power consumption increases from L2 to L3. Next, during a period up to s6, the grinding wheel T is maintained at the same position in the X-axis direction so as to perform spark-out grinding.

The period between s2 and s6 is a machining section A' corresponding to the grinding area A of the workpiece W. In the present example, similar grinding operations are performed in the sections B' and C', and the grinding is completed at s7. After that, in a subsequent period up to s8, the coolant supply apparatus 20 is stopped by the drive circuit (DU_C) 204, so that the power consumption drops to L1. Further, in a subsequent period up to s9, the Z-axis movable unit 13 and the X-axis movable unit 15 are moved in the Z-axis and X-axis directions by means of the drive circuit (DU_Z) 201 and the drive circuit (DU_X) 202, whereby the Z-axis movable unit 13 and the X-axis movable unit 15 are returned to their initial positions.

Since the grinding of the workpiece W is completed by the above-described operation, by means of the drive circuit (DU_S) 205 and the drive circuit (DU_T) 203, the spindle motors 24 are stopped so as to stop rotation of the workpiece W, and rotation of the grinding wheel T is stopped. As a result, the power consumption returns to zero.

Next, there will be described the power consumption curve for the case where a conventional cylindrical grinding machine grinds the workpiece W shown in FIG. 6B. In the following, portions of the power consumption curve identical to those of the power consumption curve for the cylindrical grinding machine of the present embodiment will be described in a simplified manner.

After completion of machining preparations, as in the case of the cylindrical grinding machine of the present embodiment, the workpiece W is rotated at a predetermined speed, and the grinding wheel T is rotated. The power consumption at this time is M1, which is greater than the power consumption L1 of the cylindrical grinding machine of the present embodiment. This is because in the conventional grinding machine, the diameter of the grinding wheel T and that of the wheel shaft 19 are large, resulting in an increase in power consumption. Next, at time s1, supply of coolant to a grinding point is started. The power consumption at this time is M2.

Next, the machining section A" corresponding to the grinding area A of the workpiece W will be described. The conventional grinding machine is the same as the grinding machine of the present embodiment in terms of approaching period (s3 to s4), grinding period (s4 to s5), and spark-out period (s5 to s6). The power consumptions of the conventional grinding machine in these periods are M2, M5, and M2, respectively. Accordingly, the conventional grinding machine differs from the grinding machine of the present embodiment only in the time or period of indexing operation.

The time u2 (s2 to s3) of indexing operation in the conventional grinding machine is longer than the time u1 (s2 to s3) of indexing operation in the grinding machine of the present embodiment. However, in the conventional grinding machine, the power consumption levels at the time of indexing in the Z-axis direction and that at the time of indexing in the X-axis direction are M3 and M4, respectively, which are smaller in increase ratio than those in the grinding machine of the present embodiment. This is because in the conventional grinding machine the wheel head (movable section) has a large mass, and a ball screw mechanism is employed as a feed mechanism, so that the wheel head cannot be moved at high speed.

Accordingly, the power consumption M3 or M4 at the time of indexing does not exceed the power consumption M5 at the time of grinding. Similar grinding operations are performed in the sections B" and C", and then the coolant supply apparatus is stopped. After that, the grinding wheel is returned to its initial position, and the grinding work ends at s10.

Figures 7, 8:
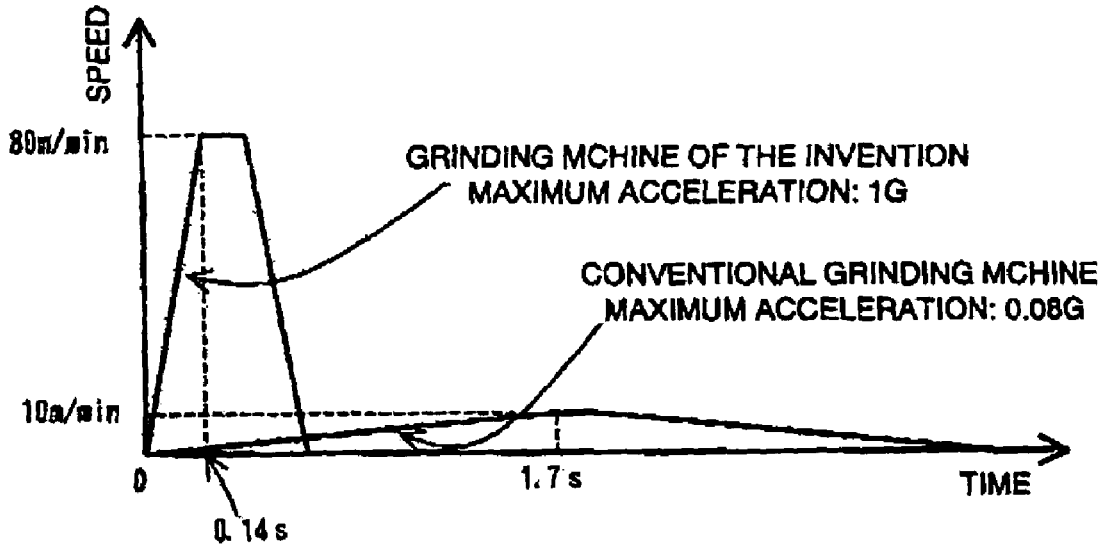
FIG. 7 is a table showing, for comparison, a portion of the specifications of the grinding machine according to the embodiment of the present invention and a portion of the specifications of the conventional grinding machine.
FIG. 8 is a time chart showing, for comparison, a velocity profile of the wheel head of the grinding machine according to the embodiment and that of the wheel head of the conventional grinding machine.

FIG. 7 is a table showing, for comparison, a portion of the specifications of the grinding machine according to the present embodiment of the present invention and a portion of the specifications of the conventional grinding machine. In the conventional grinding machine, an ordinary grinding wheel having an outer diameter of about 350 mm and a mass of 15 kg is used. In contrast, in the grinding machine of the present embodiment, a CBN grinding wheel is used so that the outer diameter of the grinding wheel is reduced to about 150 mm, and the mass thereof is reduced to 1.2 kg. In addition, the wheel shaft 19 is supported at opposite ends, rather than supported in a conventional cantilever fashion, and thus, bearing support rigidity is increased. Therefore, the diameter of the wheel shaft 19 is reduced from 75 mm to 40 mm.

Moreover, the method of supplying and collecting lubrication oil is improved so as to reduce the amount of lubrication oil used and eliminate the necessity of an oil reservoir portion. Thus, the mass of the movable portion to be moved at the time of indexing is greatly reduced from about 800 kg (conventional grinding machine) to 150 kg. By virtue of the reduced mass of the movable portion and the improved drive efficiency attained through employment of linear motor drive, in the grinding machine of the present embodiment, the wheel head can move at a maximum acceleration of 1 G, which is considerably high as compared with the maximum acceleration (0.08 G) of the conventional grinding machine.

FIG. 8 is a time chart showing, for comparison, a velocity profile of the wheel head of the grinding machine according to the embodiment and that of the wheel head of the conventional grinding machine. According to the linear motor drive of the present invention, when the wheel head of 150 kg is accelerated at the maximum acceleration of 1 G for 0.14 sec, the wheel head reaches a maximum speed 80 m/min. When the wheel head is accelerated at the maximum acceleration (1 G) for 0.14 sec and decelerated at the maximum deceleration (1 G) for 0.14 sec. the wheel head moves about 50 mm. Accordingly, in most indexing operations, the indexing operation can be performed by causing the wheel head to accelerate at the maximum acceleration without reaching the maximum speed.

In contrast, in the conventional grinding machine, when the wheel head of 350 kg is accelerated at the maximum acceleration of 0.08 G for 1.7 sec. the wheel head reaches a maximum speed 10 m/min. Since the efficiency of conversion of rotational force to propelling force for the wheel head by means of a ball-screw feed mechanism is low, the above-mentioned accelerating performance is lower in actuality. Accordingly, in most indexing operations, even when the wheel head is accelerated at the maximum acceleration, it does not reach the maximum speed, so that the index operation requires a long time.

The above-described difference will be described with reference to FIG. 6A. In the grinding machine of the present embodiment, the indexing time u1 can be shortened, and the power consumption L5 associated with indexing can be increased. Since the indexing is performed by driving the Z-axis movable unit 13 and the X-axis movable unit 15 by use of linear motors, the propelling force can be generated at high efficiency, even when the power consumption (drive power) is increased. Accordingly, the indexing operation can be completed within a very short period of time as shown by the velocity profile in FIG. 8. Moreover, since the indexing operation can be completed within a very short period of time, even when the power consumption L5 is made greater than the power consumption L3 at the time of grinding, energy savings can be achieved, because the rated power of the grinding machine is determined on the basis of the power consumption L3 at the time of grinding.

Meanwhile, in the conventional grinding machine, the index operation time u2 is long, and the power consumption M4 required for indexing cannot be made large because of the following reasons. Since the wheel head having a large mass is moved by a ball-screw feed mechanism, even when the power consumption M4 is increased, the feed mechanism does not follow. As a result, a desired effect cannot be attained although the rated power increases.

As is apparent from the above, the grinding machine according to the present embodiment can shorten the time required to complete indexing, and can greatly shorten the machining time, in particular in the case where a workpiece has a shape which requires a large number of indexing operations before completion of grinding. As compared with the conventional grinding machine having specifications as shown in FIG. 7, the grinding machine of the present embodiment (its specifications are also shown in FIG. 7) can shorten machining time by 10 to 20%. That is, a time corresponding to a hatched portion of FIG. 6A is eliminated. In the period corresponding to the hatched portion, the spindle motors 24 are driven by the drive circuit (DU_S) 205 so as to rotate the workpiece W at a predetermined speed, the grinding wheel T is rotated by the drive circuit (DU_T) 203, and the coolant supply apparatus 20 is driven by the drive circuit (DU_C) 204 so as to supply coolant to a grinding point, so that a large quantity of energy is consumed. Accordingly, the present invention can provide an environment-friendly, energy-saving grinding machine which can reduce the quantity of consumed energy.

Moreover, in the case where a target regarding reduction of consumed energy is determined, a time by which machining time must be shortened (shortening time) can be determined from a predetermined quantity of consumed energy to be reduced.

This will be described with reference to FIG. 6A. The respective times for indexing operation; i.e. positioning operation, are set such that the time corresponding to the hatched portion; i.e., the total of reductions in the times of indexing operations performed for the respective machining areas, and a reduction in the time required to return the Z-axis movable unit 13 and the X-axis movable unit 15 to their initial positions, becomes the target shortening time. In this case, the power consumption L5 at the time of indexing is not required to be greater than the power consumption L3 at the time of grinding. According to this embodiment as well, an environment-friendly, energy-saving grinding machine which can reduce the quantity of consumed energy can be provided.

Test Example

Figure 9A:
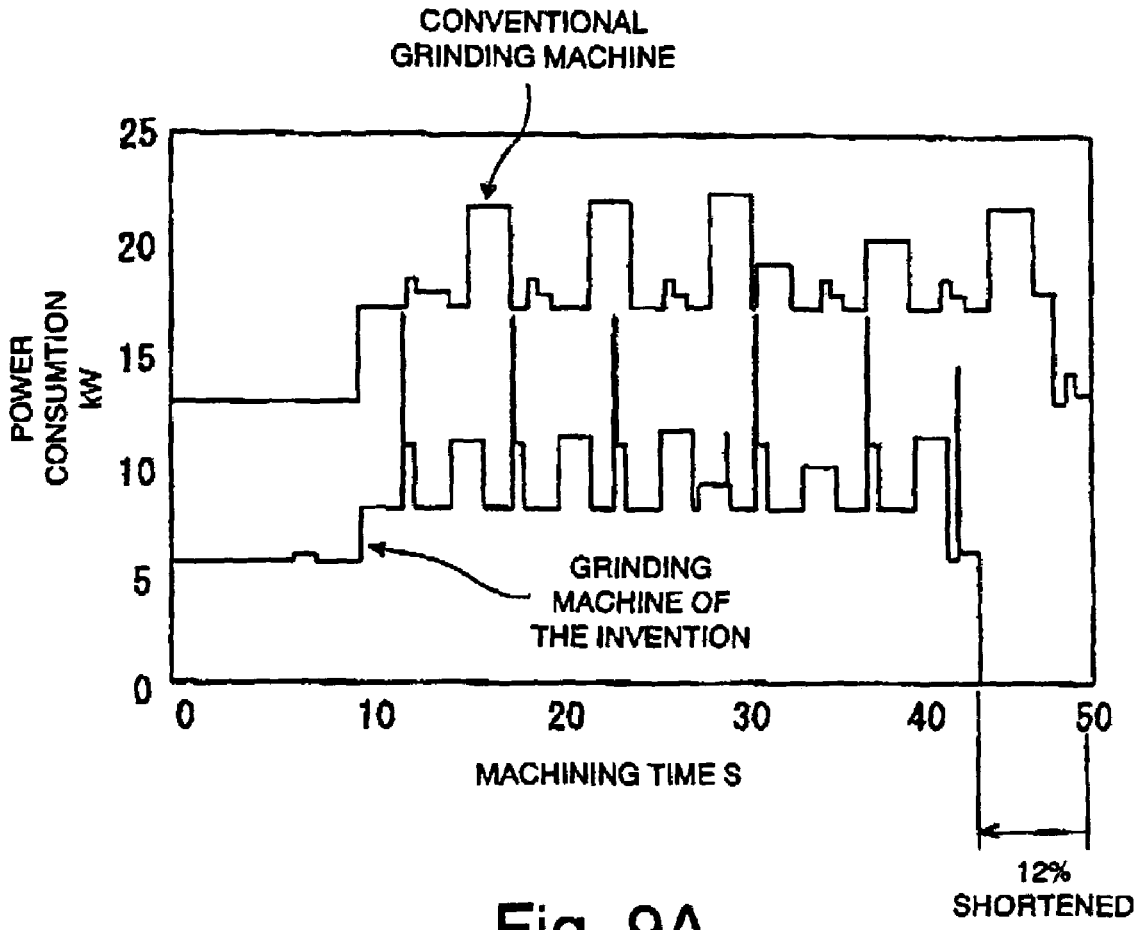
FIG. 9A is a time chart obtained through test operations and showing changes in consumed power with machining time in the conventional grinding machine and changes in consumed power with machining time in the grinding machine according to the embodiment.
Figure 9B:
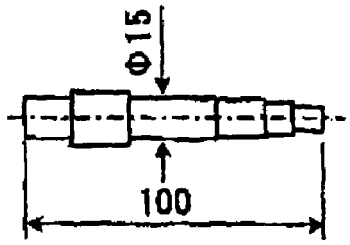
FIG. 9B is a schematic view showing the shape of a workpiece used in the test operations.

FIG. 9A is a time chart obtained through test operations and showing changes in power consumption with machining time in the conventional grinding machine and changes in power consumption with machining time in the grinding machine according to the embodiment, wherein a workpiece W shown in FIG. 9B was used in the test operations.

The workpiece W is a five-step stepped shaft and has five machining areas. In the case of the grinding machine according to the embodiment, the total machining time was 44 sec. which is 12% shorter than the total machining time (50 sec) of the conventional grinding machine. This means that energy consumed to grind a single workpiece W is reduced by about 0.03 kWh.

Obviously, numerous modifications and variations of the present invention are possible in light of the above teachings. It is therefore to be understood that within the scope of the appended claims, the present invention may be practiced otherwise than as specifically described herein.

What is claimed is:

1. A method of grinding at least first and second axially separated grinding areas of a generally cylindrical, elongated workpiece on a grinding machine, wherein the workpiece is rotatably supported by a main spindle disposed on a bed of the grinding machine, and the grinding areas of the workpiece are ground by a grinding wheel supported on a movable body movably disposed on the bed, the method comprising;

a first grinding step of grinding the first grinding area of the workpiece by the grinding wheel for a first period of time such that power consumed by the grinding machine is maintained at a first level; a second grinding step of grinding the second grinding area of the workpiece by the grinding wheel for a second period of time such that power consumed by the grinding machine is maintained at about the first level; and a positioning step of moving the grinding wheel, after completion of the first grinding step, and before the second grinding step to the second grinding area by moving the movable body for a second period of time such that the power consumed by the grinding machine is maintained at a second level higher than the first level, the second period of time being determined in accordance with the second level.

2. A grinding method according to claim 1, wherein the positioning step comprises:

a first moving step of moving the movable body in a direction perpendicular to an axis of the workpiece; and a second moving step of moving the movable body in a direction parallel to the axis of the workpiece.

3. A grinding machine comprising:

a spindle head disposed on a bed of the grinding machine and adapted to support and rotate a generally cylindrical, elongated workpiece having at least first and second axially separated grinding areas to be ground;

a grinding wheel rotatably supported on a wheel head movably disposed on the bed;

a feed mechanism including motors for moving the grinding wheel in a direction parallel to an axis of the workpiece and in a direction perpendicular to the axis of the workpiece;

drive circuits connected to the motors and driving the motors; and a control apparatus connected to the drive circuits and controlling movement of the grinding wheel relative to the workpiece so as 1) grind the first grinding area of the workpiece by the grinding wheel for a first period of time such that power consumed by the grinding machine is maintained at a first level; 2) grind the second grinding area of the workpiece by the grinding wheel for a second period of time such that power consumed by the grinding machine is maintained at about the first level; and 3) move the grinding wheel, after completion of grinding the first grinding area and before grinding the second grinding area, to the second grinding area by moving the wheel head for a second period of time such that the power consumed by the grinding machine is maintained at a second level higher than the first level, the second period of time being determined in accordance with the second level.

4. A grinding machine according to claim 3, wherein the motors are linear motors.

5. A grinding machine according to claim 3, wherein after completion of grinding for the first grinding area, the control apparatus moves the grinding wheel to the second grinding area by moving the wheel head at an acceleration corresponding to a mass of the wheel head for a period of time corresponding to the acceleration.

6. A grinding machine according to claim 5, wherein the control apparatus moves the grinding wheel to the second grinding area by accelerating the wheel head at an acceleration corresponding to the mass of the wheel head and then decelerating the wheel head at a deceleration having an absolute value approximately equal to that of the acceleration.

7. A grinding machine for grinding at least first and second axially separated grinding areas of a generally cylindrical, elongated workpiece, wherein the workpiece is rotatably supported by a main spindle disposed on a bed of the grinding machine, and the grinding areas of the workpiece are ground by a grinding wheel supported on a movable body movably disposed on the bed, the grinding machine comprising:

grinding means for grinding the first grinding area of the workpiece by the grinding wheel for a first period of time such that power consumed by the grinding machine is maintained at a first level; grinding means for grinding the second grinding area of the workpiece by the grinding wheel for a second period of time such that power consumed by the grinding machine is maintained at about the first level; and positioning means for moving the grinding wheel, after completion of grinding the first grinding area and before grinding the second grinding area, to the second grinding area by moving the movable body for a second period of time such that the power consumed by the grinding machine is maintained at a second level higher than the first level, the second period of time being determined in accordance with the second level.

8. A grinding machine according to claim 7, wherein the positioning means comprises:

first moving means for moving the movable body in a direction perpendicular to an axis of the workpiece; and second moving means for moving the movable body in a direction parallel to the axis of the workpiece.

* * * * *